US010463223B2

(12) United States Patent
Meurer

(10) Patent No.: US 10,463,223 B2
(45) Date of Patent: Nov. 5, 2019

(54) WET PUMP WITH FLUID FLOW PATH FOR EXCLUDING PARTICULATES

(71) Applicant: WHIRLPOOL CORPORATION, Benton Harbor, MI (US)

(72) Inventor: Evandro Jacob Meurer, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 353 days.

(21) Appl. No.: 15/338,398

(22) Filed: Oct. 30, 2016

(65) Prior Publication Data

US 2018/0116484 A1 May 3, 2018

(51) Int. Cl.

| | |
|---|---|
| ***A47L 15/42*** | (2006.01) |
| ***F04D 29/06*** | (2006.01) |
| ***F04D 13/06*** | (2006.01) |

(52) U.S. Cl.

CPC ..... *A47L 15/4223* (2013.01); *A47L 15/4225* (2013.01); *F04D 13/0606* (2013.01); *F04D 29/061* (2013.01)

(58) Field of Classification Search

CPC ..... A47L 15/4223

See application file for complete search history.

(56) References Cited

FOREIGN PATENT DOCUMENTS

| | | | |
|---|---|---|---|
| CN | 203730341 U | 7/2014 | |
| DE | 102006045781 A1 * | 4/2008 | ..... H02K 5/167 |

OTHER PUBLICATIONS

Machine translation of DE102006045781A1.*

Ebay listing for Samsung Dishwasher Assy-Sump Better;DMT400 Part #DD94-01025A, accessed Oct. 28, 2016 at http://www.ebay.com/itm/Used-Samsung-Dishwasher-ASSY-SUMP-BETTER-DMT400-Part-DD94-01025A-/282137175651?nma=true&si=AaewHwnCPgbe2Xm79X2hBZVVDg6M%253D&orig_cvip=true&rt=nc&_trksid=p2047675.l2557.

* cited by examiner

*Primary Examiner* — Michael E Barr
*Assistant Examiner* — Jason P Riggleman
(74) *Attorney, Agent, or Firm* — McGarry Bair PC

(57) ABSTRACT

A wash pump with a bearing plate in a dishwasher, comprising a novel method for filtering particulates from the wash water by having inlets of a restricted dimension in the bearing plate and subsequent further restrictions provided to the flow path of water by structural ribs and reliefs, thereby avoiding clogging of the rotor shaft clearance.

15 Claims, 6 Drawing Sheets

WET PUMP WITH FLUID FLOW PATH FOR EXCLUDING PARTICULATES

BACKGROUND

Wash pumps in dishwashers are utilized to recirculate the wash liquid from the sump to the spray nozzles to be used during the operation of the dishwasher. These wash pumps are typically wet pumps, which use the liquid that they recirculate to lubricate/cool the bearing and the rotor shaft of the wash pump motor, thereby avoiding introduction of another fluid to the system.

To direct the wash liquid to the rotor shaft, a hole is traditionally placed in a bearing plate, which is positioned very close to and is directly fluidly coupled to the axis of rotation of the rotor shaft. Because the wash liquid contains particles of soil from the dishes, the particles can accumulate in the clearance between the rotor shaft and the housing over time, eventually causing physical obstruction to the rotation of the rotor shaft, thereby causing it to overheat and/or slow down or jam. This prevents proper functioning of the wash pump, and impedes the proper operation of the dishwasher.

BRIEF SUMMARY

In one aspect, a dishwasher comprises a tub at least partially defining a dish treating chamber, a recirculation circuit fluidly coupled to the dish treating chamber, a wet pump fluidly coupled to the recirculation circuit and comprising a pump motor housing defining a stator chamber, a bearing plate overlying the stator chamber and having a shaft opening and forming an interface with the pump motor housing, a stator provided with the pump motor housing, a rotor located interiorly of the stator and within the stator chamber and having an output shaft extending through the shaft opening of the bearing plate, an impeller mounted to the shaft, and a lubricant flow path comprising at least one inlet provided in the bearing plate spaced from the shaft opening, and at least one relief in at least one of the bearing plate or the pump motor housing at the interface, wherein the inlet is in fluid communication with the relief.

DETAILED DESCRIPTION

Figure 1:
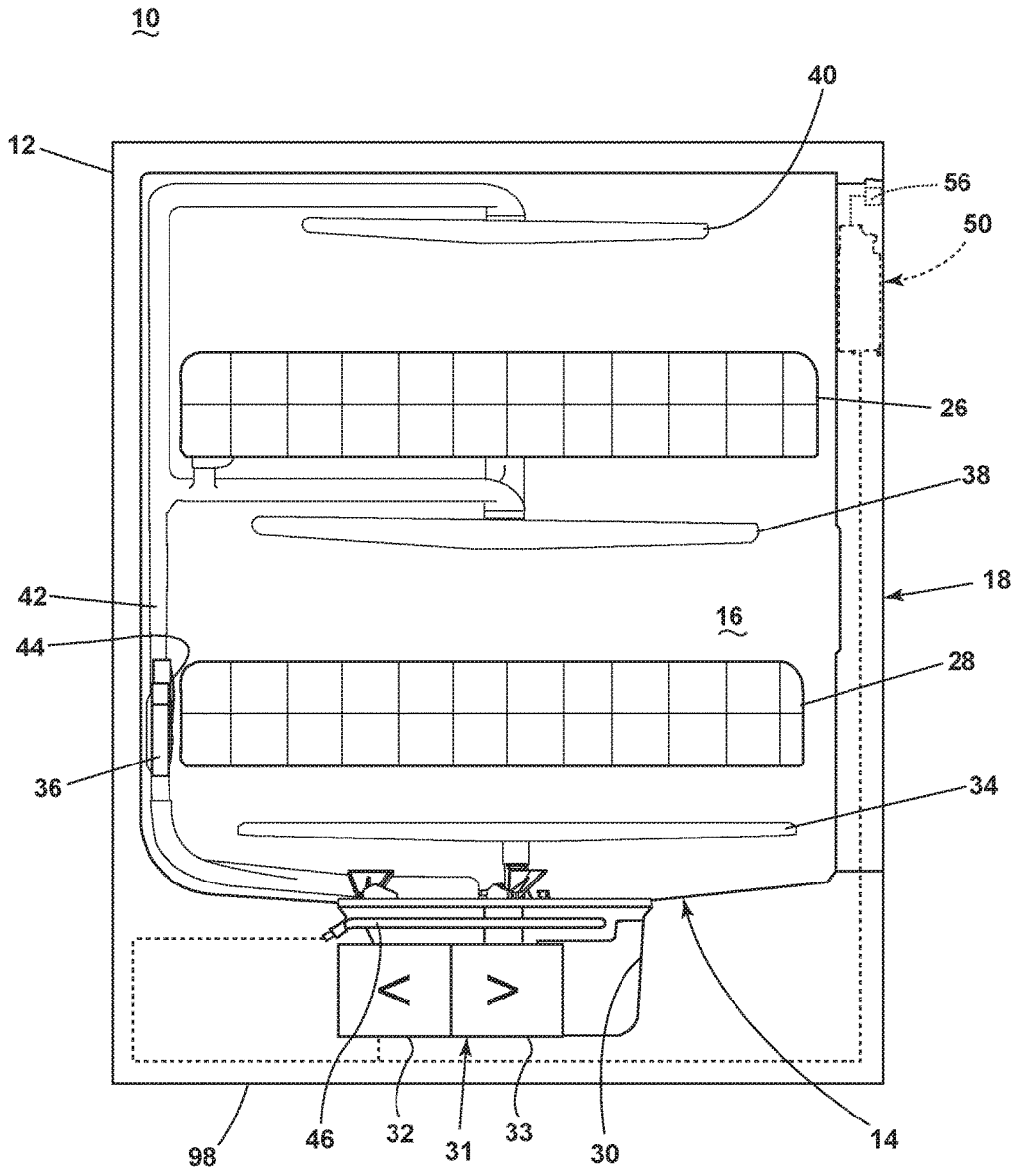
FIG. 1 is a schematic, cross-sectional view of a dishwasher providing an environment for a wet pump according to various concepts disclosed herein.

FIG. 1 illustrates a schematic, cross-sectional view of an automated dishwasher 10. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a dish treating chamber 16 having an open face for washing dishes. A door assembly 18 may be movably mounted to the dishwasher 10 for movement between opened and closed positions to selectively open and close the open face of the tub 14. Thus, the door assembly provides accessibility to the dish treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the dish treating chamber 16 may be prevented, whereas user access to the dish treating chamber 16 may be permitted when the door assembly 18 is open.

Dish holders, illustrated in the form of upper and lower dish racks 26, 28, are located within the dish treating chamber 16 and receive dishes for washing. The upper and lower racks 26, 28 are typically mounted for slidable movement in and out of the dish treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the dish treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the dish treating chamber 16. The second lower spray assembly 36 is illustrated as including a vertically oriented distribution header or spray manifold 44.

A circuit, such as recirculation circuit is provided for recirculating liquid from the dish treating chamber 16 to the spray system. The recirculation circuit may include a sump 30 and a pump assembly 31. The sump 30 collects the liquid sprayed in the dish treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. The sump 30, recirculation pump 33, supply tube and any one of the spray assemblies 34, 36, 38 and 40 collectively form the recirculation circuit as liquid sprayed from the spray assemblies 34, 36, 38 and 40 collects in the sump 30, where the recirculation circuit then pumps the liquid back to the spray assemblies 34, 36, 38 and 40 via the supply tube 42. The recirculation pump 33 can be implemented as a wet pump that uses the recirculated liquid to lubricate/cool the recirculation pump 33. A wet pump is a pump wherein the pumped medium is used to lubricate a pump bearing assembly 69 and a rotor 72.

While not shown, a liquid supply circuit may include a water supply conduit coupled with a household water supply for supplying water to the dish treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
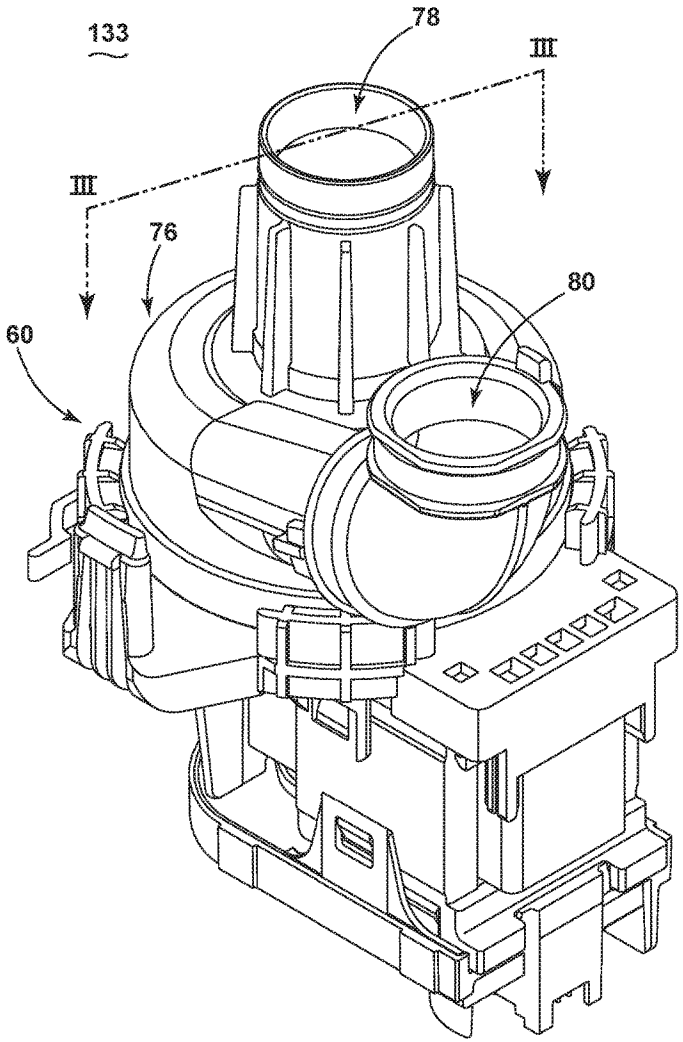
FIG. 2 is a perspective view of one implementation of the wet pump of FIG. 1.

FIG. 2 illustrates a perspective view of a wet pump 133, which is a specific implementation of the recirculation pump 33. The wet pump 133 comprises a motor housing 60 and a volute housing 76. The volute housing 76 in turn comprises a liquid inlet 78 and a liquid outlet 80. The liquid inlet 78 and the liquid outlet 80 comprise part of the recirculation circuit that is fluidly coupled to the dish treating chamber 16.

Figure 3:
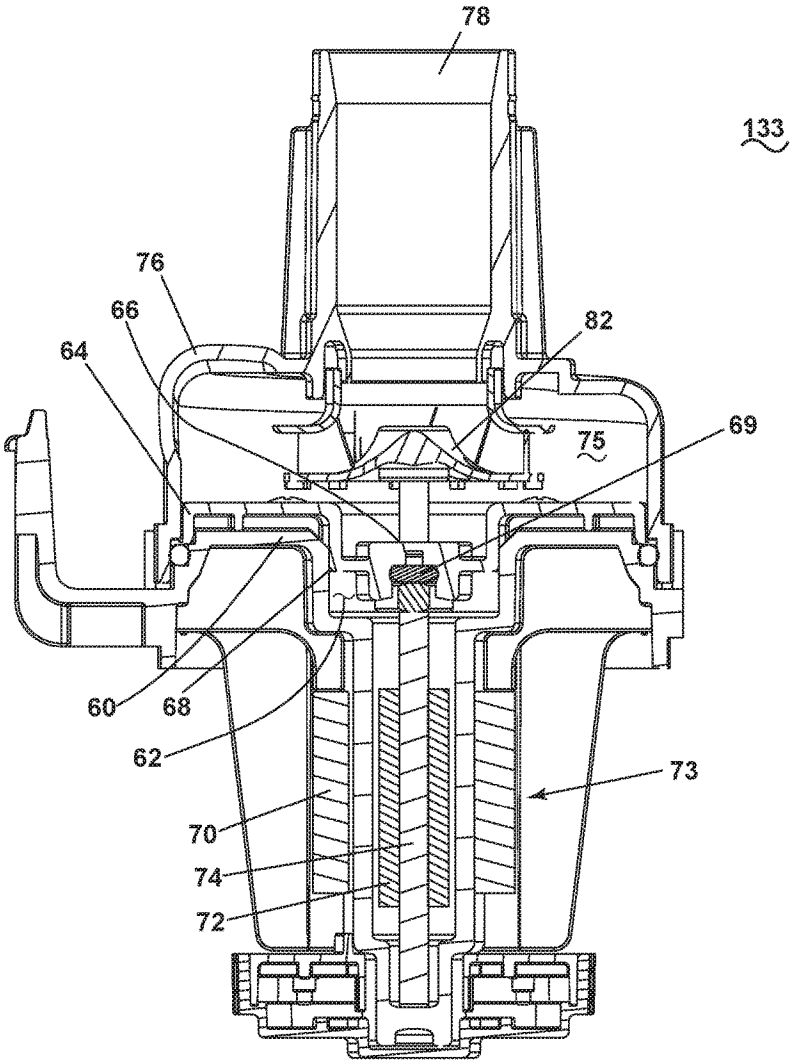
FIG. 3 is a cross-sectional view of the wet pump of FIG. 2 taken along line III-III.

FIG. 3 illustrates a cross-sectional view of the wet pump 133. A bearing plate 64 in combination with the motor housing 60 and volute housing 76 divides the interior of the wet pump 133 into a stator chamber 62 and a volute chamber 75, respectively. The bearing plate 64 overlies the stator chamber 62 and has a shaft opening 66 and forms an interface 68 with the motor housing 60.

A motor 73 is at least partially located within the motor housing 60 and comprises a stator 70 and the rotor 72, which has an output shaft 74 extending through a shaft opening 66 in the bearing plate 64 and into the volute chamber 75. The axis of rotation output shaft 74 of the rotor 72 is oriented horizontally with respect to a bottom surface 98 of the dishwasher 10, when the wet pump 133 is installed, as shown in FIG. 1. The bearing assembly 69 is mounted to the bearing plate 64 and circumscribes the shaft opening 66 and rotationally supports the output shaft 74. An impeller 82 is mounted to the end of the output shaft 74 and is located within the volute chamber 75.

Figure 4:
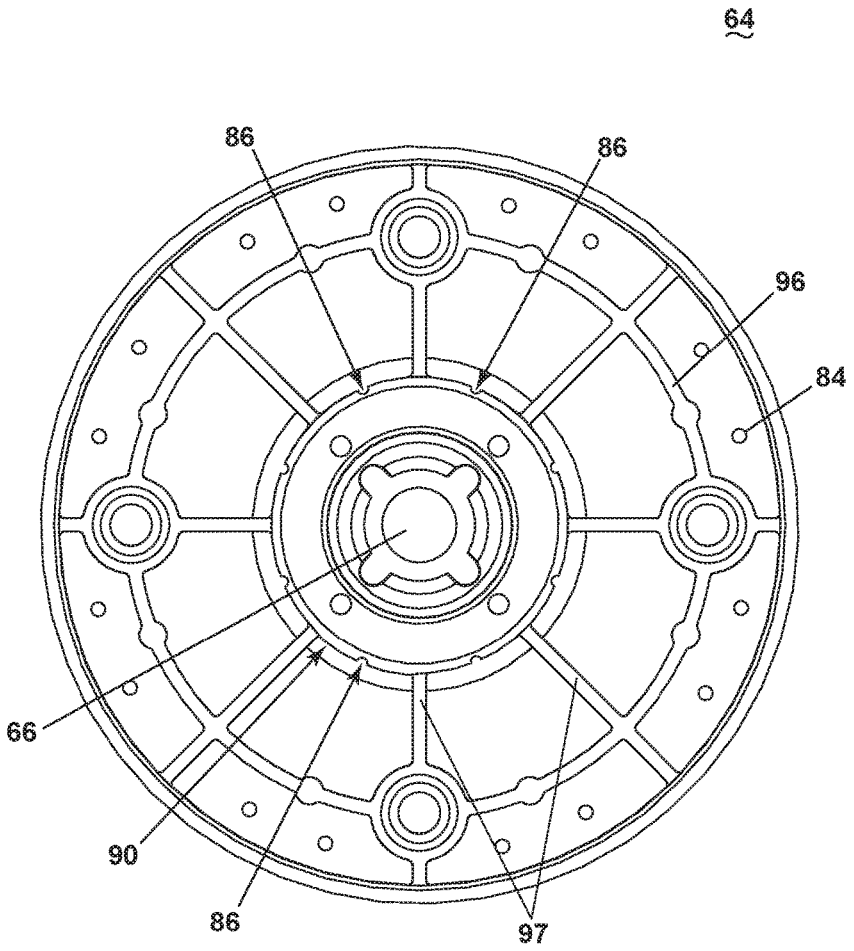
FIG. 4 is a bottom view of a bearing plate of the wet pump of FIG. 3.

FIG. 4 illustrates the bottom view of the bearing plate 64. The bearing plate 64 has a structural rib 96, which encircles the shaft opening 66. The bearing plate 64 has several radial ribs 97 that intersect with the structural rib 96. The bearing plate 64 has at least one inlet 84. In this aspect, the inlets 84 are shown to be circular in shape. There are multiple inlets 84 spaced circumferentially about the bearing plate 64. The bearing plate 64 further includes a bearing seat 90 about which is formed at least one relief 86. There are multiple reliefs 86 spaced about the bearing seat 90. The bearing seat 90 supports the bearing assembly 69. Alternatively, the relief 86 may also be provided along the length of the structural rib 96.

Figure 5:
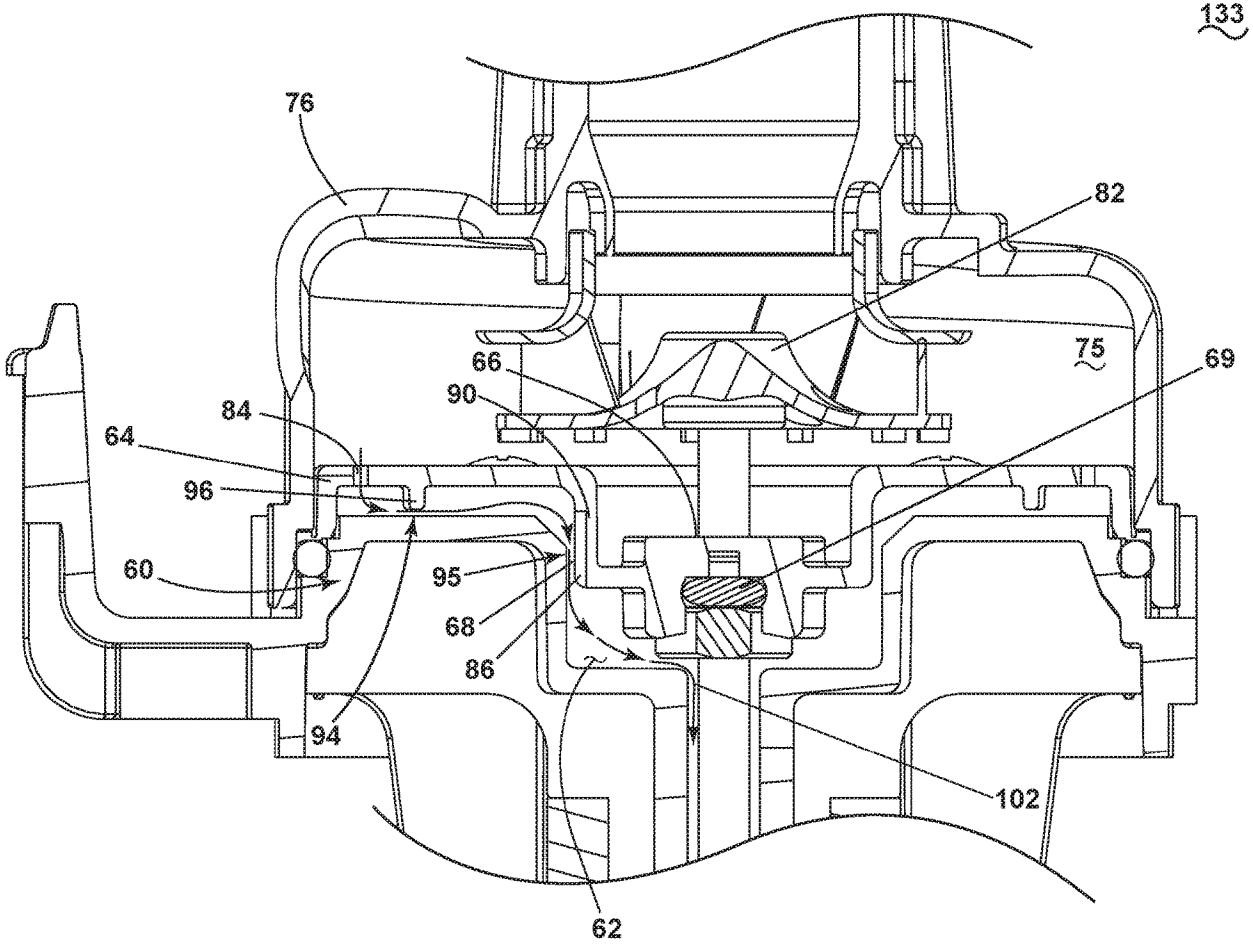
FIG. 5 is an enlarged view of FIG. 3 focusing on where the bearing plate and a pump motor housing meet, and the surrounding area.

Referring to FIG. 5, a lubricant flow path 102 extends from the volute chamber 75 to the stator chamber 62 and provides a liquid path along which liquid can pass to lubricate or cool the bearing assembly 69. The flow path 102 is defined by specific structural features of the bearing plate 64 and the relationship of some of these structural features relative to the motor housing 60. For example, the structural rib 96 and the motor housing 60 define a gap 94. A further example is that the relief 86 of the bearing plate 64 and the motor housing 60 define another gap 95. The inlet 84 and gaps 94, 95 define the lubricant flow path 102, which fluidly couples the volute chamber 75 to the stator chamber 62. As there are multiple inlets 84 and multiple reliefs 86, and corresponding gaps 94, 95, there are multiple flow paths 102 spaced about the bearing seat 90.

The size of the inlet and the gaps 94, 95 are controlled to control the size of the particle than can reach the stator chamber 62. The inlet 84 and the gaps 94, 95 have a maximum dimension, less than or equal to 1 mm. Preferably, the inlet 84 and the gaps 94, 95 each have a maximum dimension that is less than or equal to 0.5 mm.

Figure 6:
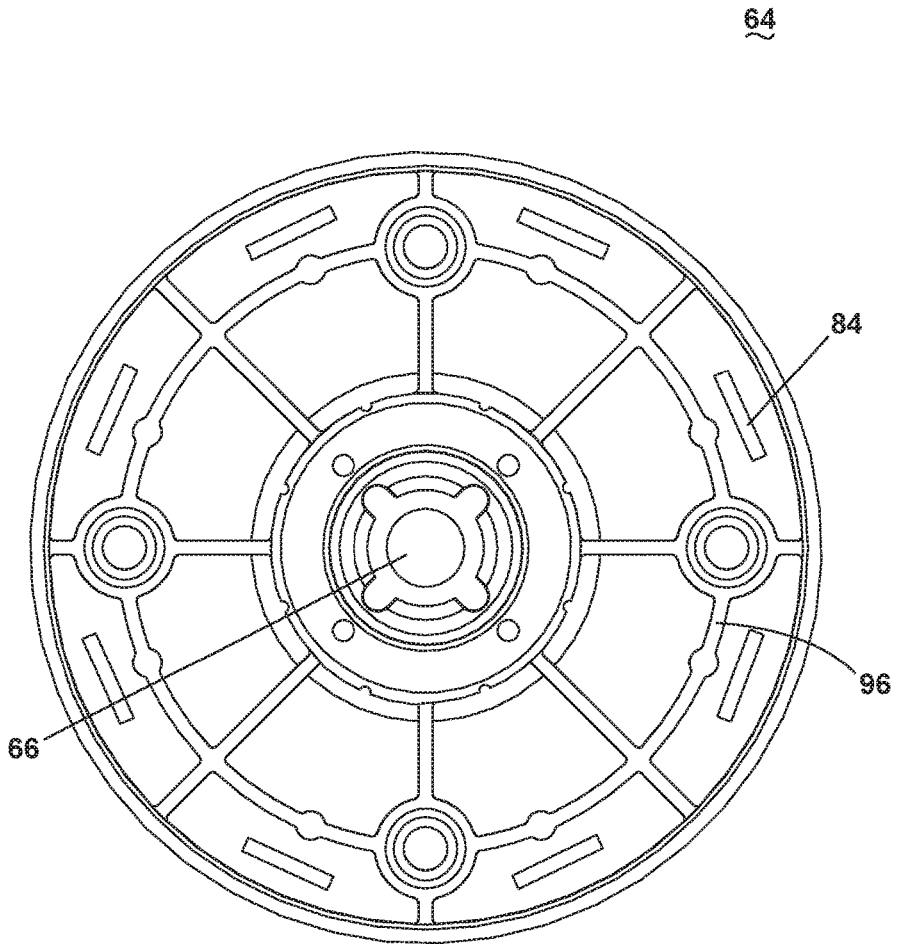
FIG. 6 is a bottom view of a bearing plate according to another aspect of the invention.

FIG. 6 illustrates the bottom view of the bearing plate 64 according to another aspect. The bearing plate 64 shown in FIG. 6 is similar to the bearing plate 64 shown in FIG. 4, except that the bearing plate 64 in FIG. 6 has polygonal inlets 84.

During operation, the rotor 72 rotates, causing the output shaft 74 to rotate with it as it is coupled to the rotor 72. This in turn rotates the impeller 82. The impeller 82 pushes the liquid in the pump radially outward, and the lower pressure thus created causes liquid to flow into the volute chamber 75 via the liquid inlet 78. The liquid flows in a circular path along the direction of rotation of the impeller 82 until it exits the volute chamber 75 via the liquid outlet 80.

A portion of the liquid flows into the lubricant flow path 102 via the inlet 84 and the gaps 94, 95. As these each have a restricted maximum dimension, this allows for particulates to not reach the stator chamber 62 and thus the rotor 72 is lubricated without the risk of clogging, thereby avoiding untimely malfunction of the wet pump 133. As the pump is oriented horizontally relative to the bottom surface 98, during filling and draining of the wet pump 133, no air gaps are formed as some of the inlets 84 serve as an escape for air.

The flow path 102 also defines a labyrinth type flow path as the liquid must change direction at each of the inlet 84 and gaps 94, 95.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Moreover, while "a set of" various elements have been described, it will be understood that "a set" can include any number of the respective elements, including only one element. Combinations or permutations of features described herein are covered by this disclosure.

This written description uses examples to disclose embodiments of the invention, and also to enable any person skilled in the art to practice embodiments of the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dishwasher comprising:

a tub at least partially defining a dish treating chamber;

a recirculation circuit fluidly coupled to the dish treating chamber;

a wet pump fluidly coupled to the recirculation circuit and comprising:

a pump motor housing defining a stator chamber;

a bearing plate overlying the stator chamber and having a shaft opening and forming an interface with the pump motor housing;

a stator provided with the pump motor housing;

a rotor located interiorly of the stator and within the stator chamber and having an output shaft extending through the shaft opening of the bearing plate;

an impeller mounted to the shaft; and a lubricant flow path comprising at least one inlet provided in the bearing plate spaced from the shaft opening, and at least one relief in at least one of the bearing plate or the pump motor housing at the interface, wherein the inlet is in fluid communication with the relief.

2. The dishwasher of claim 1 wherein the inlet is less than 1 mm at its maximum dimension.

3. The dishwasher of claim 2 wherein the maximum dimension is less than or equal to 0.5 mm.

4. The dishwasher of claim 2 wherein the relief has the same maximum dimension as the inlet.

5. The dishwasher of claim 1 further comprising a bearing assembly mounted within the bearing plate and the lubricant flow path is in fluid communication with the bearing assembly.

6. The dishwasher of claim 5 wherein the bearing plate comprises a bearing seat holding the bearing assembly and the bearing seat abuts a portion of the pump motor housing to define the interface.

7. The dishwasher of claim 6 wherein the relief is formed in the bearing seat.

8. The dishwasher of claim 7 wherein the at least one inlet comprises multiple inlets spaced about the shaft opening and the at least one relief comprises multiple reliefs spaced about the bearing seat.

9. The dishwasher of claim 8 comprising at least one structural rib provided with the bearing plate between the multiple inlets and the multiple reliefs and extending toward the pump motor housing and defining a gap therebetween.

10. The dishwasher of claim 9 wherein the gap has a maximum dimension of less than 1 mm.

11. The dishwasher of claim 10 wherein the maximum dimension of the gap is less than or equal to 0.5 mm.

12. The dishwasher of claim 9 wherein the structural rib and the corresponding gap circumscribe the shaft opening.

13. The dishwasher of claim 8 wherein the wet pump is oriented such that the output shaft rotates on a horizontal axis.

14. The dishwasher of claim 13 wherein the recirculation circuit includes a sump and the impeller is fluidly coupled to the sump.

15. The dishwasher of claim 1 wherein the bearing plate comprises at least one of a bearing seat or a structural rib and the relief is formed in the at least one of the bearing seat and the structural rib.

* * * * *